US007464830B2

(12) United States Patent
Baughman

(10) Patent No.: US 7,464,830 B2
(45) Date of Patent: Dec. 16, 2008

(54) CLOSURE ASSEMBLY FOR A CONTAINER

(75) Inventor: Gary M. Baughman, Auburn, IN (US)

(73) Assignee: Rieke Corproation, Auburn, ID (US)

( * ) Notice: Subject to any disclaimer, the term of this patent is extended or adjusted under 35 U.S.C. 154(b) by 323 days.

(21) Appl. No.: 10/971,874

(22) Filed: Oct. 22, 2004

(65) Prior Publication Data

US 2005/0269330 A1 Dec. 8, 2005

Related U.S. Application Data

(63) Continuation-in-part of application No. 10/863,738, filed on Jun. 8, 2004.

(51) Int. Cl.
*B65D 6/40* (2006.01)

(52) U.S. Cl. ..... 220/601; 220/288; 220/304

(58) Field of Classification Search ..... 220/288, 220/289, 304, 601, 254.8
See application file for complete search history.

(56) References Cited

U.S. PATENT DOCUMENTS

| | | | | |
|---|---|---|---|---|
| 1,489,040 | A | 4/1924 | Parsons | |
| 1,513,637 | A | 10/1924 | Schwartz | |
| 1,702,532 | A | 2/1929 | Boomer | |
| 1,822,114 | A | 9/1931 | Schwartz | |
| 1,838,042 | A | 12/1931 | Schwartz | |
| 1,851,938 | A | 3/1932 | Rieke | |
| 1,856,747 | A | 5/1932 | Cooper | |
| 1,919,597 | A | 7/1933 | Bertram | |
| 1,945,495 | A | 1/1934 | Rieke | 220/39 |
| 1,947,425 | A | 2/1934 | Rieke | 285/49 |
| 1,952,036 | A | 3/1934 | Dillhoefer, Jr. | 220/39 |

(Continued)

FOREIGN PATENT DOCUMENTS

DE 880 413 C 6/1953

(Continued)

OTHER PUBLICATIONS

Product description of VISEGRIP® Flange, style S-250, offered by Rieke Corporation since 1950.

(Continued)

*Primary Examiner*—Anthony D Stashick
*Assistant Examiner*—Christopher B McKinley
(74) *Attorney, Agent, or Firm*—Woodward, Emhardy, Moriarty, McNett & Henry LLP

(57) ABSTRACT

A closure assembly for a container including an internally-threaded annular flange, an externally-threaded closure plug that is received by the annular flange, and an annular gasket positioned between the annular flange and the closure plug for establishing a sealed interface. The container includes a container end panel that is formed over and around a portion of the annular flange and provides an inner axial wall that is positioned between the annular flange and the annular gasket. The clearance between the closing plug and the inner axial wall relative to the size of the annular gasket determines the degree of radial compression of the annular gasket as the plug is threaded into the flange. A radial lip of the plug is designed to contact an upper surface of the container end panel that is formed over the flange as a visual indication when the required tightening torque of the plug within the flange has been reached.

11 Claims, 4 Drawing Sheets

U.S. PATENT DOCUMENTS

| | | | | | |
|---|---|---|---|---|---|
| 2,160,598 | A | | 5/1939 | Melrath | 29/148.2 |
| 2,387,990 | A | * | 10/1945 | Grosser | 220/284 |
| 2,398,553 | A | | 4/1946 | Nyden | |
| 2,411,149 | A | | 11/1946 | Dodson | |
| 2,426,134 | A | | 8/1947 | Wilson | |
| 2,445,802 | A | * | 7/1948 | Robinson | 220/304 |
| 2,447,535 | A | * | 8/1948 | Robinson | 285/203 |
| 2,447,536 | A | * | 8/1948 | Robinson | 285/203 |
| 2,483,964 | A | * | 10/1949 | Bennett | 220/284 |
| 2,612,285 | A | | 9/1952 | Benson | |
| 2,643,790 | A | | 6/1953 | Quillinan | |
| 2,773,621 | A | | 12/1956 | Warren | |
| 2,842,282 | A | | 7/1958 | Parish | |
| 2,889,156 | A | | 6/1959 | Dearing | |
| 2,960,954 | A | | 11/1960 | Dearing et al. | 113/121 |
| 2,962,185 | A | * | 11/1960 | Starr et al. | 220/254.8 |
| 3,124,267 | A | | 3/1964 | Cetrone | |
| 3,149,744 | A | | 9/1964 | Pentesco | 220/39 |
| 3,264,850 | A | * | 8/1966 | Bower | 70/165 |
| 3,342,366 | A | | 9/1967 | Defauw | 220/39 |
| 3,393,823 | A | | 7/1968 | Dearing | 220/39 |
| 3,432,069 | A | | 3/1969 | Craig | |
| 3,791,021 | A | * | 2/1974 | Bauman | 29/510 |
| 3,863,800 | A | | 2/1975 | Jesevich et al. | |
| 3,946,894 | A | | 3/1976 | Simkus | 220/256 |
| 4,004,709 | A | | 1/1977 | Simkus | |
| 4,105,135 | A | * | 8/1978 | Bradshaw et al. | 220/288 |
| 4,109,600 | A | | 8/1978 | Post | 113/121 R |
| 4,117,949 | A | * | 10/1978 | Dwinell | 220/304 |
| 4,135,639 | A | * | 1/1979 | Dillon et al. | 220/288 |
| 4,164,304 | A | * | 8/1979 | Roberson | 220/214 |
| 4,231,488 | A | * | 11/1980 | Ward et al. | 220/288 |
| 4,252,246 | A | | 2/1981 | Johnson et al. | |
| 4,316,318 | A | | 2/1982 | Mineo | 29/512 |
| 4,573,605 | A | * | 3/1986 | Udell | 220/304 |
| 4,588,103 | A | * | 5/1986 | Baughman | 220/288 |
| 4,625,889 | A | | 12/1986 | Baughman | 220/288 |
| 4,677,730 | A | | 7/1987 | Mineo et al. | 29/512 |
| 4,706,836 | A | * | 11/1987 | Greck | 220/259.4 |
| 5,016,775 | A | | 5/1991 | Büdenbender | 220/288 |
| 5,154,308 | A | * | 10/1992 | Larson | 220/495.06 |
| 5,305,906 | A | * | 4/1994 | Dietrich et al. | 220/288 |
| 5,356,030 | A | * | 10/1994 | Budenbender | 220/601 |
| 5,379,913 | A | * | 1/1995 | Rieke et al. | 220/601 |
| 5,437,387 | A | | 8/1995 | Burns | |
| D388,933 | S | | 1/1998 | Hunter et al. | |
| 5,799,813 | A | | 9/1998 | Letica | |
| 5,810,190 | A | * | 9/1998 | Welch | 220/257.1 |
| 5,816,422 | A | | 10/1998 | Roig | |
| 5,881,907 | A | * | 3/1999 | Schutz | 220/644 |
| 5,960,528 | A | * | 10/1999 | Kars | 29/511 |
| D458,001 | S | | 5/2002 | Shah | |
| D460,598 | S | | 7/2002 | Shah | |
| D491,062 | S | * | 6/2004 | Hoff | D9/435 |
| 6,745,914 | B2 | | 6/2004 | Hagano et al. | |
| 2003/0132231 | A1 | | 7/2003 | Van De Klippe | 220/304 |
| 2004/0245252 | A1 | * | 12/2004 | Baughman | 220/288 |
| 2004/0256393 | A1 | * | 12/2004 | Van De Klippe et al. | 220/304 |
| 2005/0269329 | A1 | * | 12/2005 | Baughman | 220/288 |

FOREIGN PATENT DOCUMENTS

| | | | |
|---|---|---|---|
| DE | 25 01 289 | A1 | 7/1976 |
| DE | 76 32 609 | U1 | 1/1977 |
| EP | 0 215 538 | A2 | 7/1968 |

OTHER PUBLICATIONS

Product description of VISEGRIP® Flange, style S-200, offered by Rieke Corporation since 1950.
Product description of VISEGRIP® Flange, style R-4, offered by Rieke Corporation since 1950.
Product description of VISEGRIP® Flange, style R-6, offered by Rieke Corporation since 1950.
Product flier of Rieke Packaging Systems entitled "VISEGRIP® Plugs/closures", 2 pgs., (undated).
EPO Search Report dated May 7, 2008 from EP 05250510.4.

* cited by examiner

CLOSURE ASSEMBLY FOR A CONTAINER

REFERENCE TO RELATED APPLICATION

The present application is a continuation-in-part patent application of U.S. patent application Ser. No. 10/863,738, filed Jun. 8, 2004, entitled "A CLOSURE ASSEMBLY FOR A CONTAINER", now pending, which is hereby incorporated by reference in its entirety.

BACKGROUND OF THE INVENTION

The present invention relates in general to closure assemblies including a threaded flange and a threaded closing plug wherein the flange is securely installed into a container end panel or drum head, as it may be called. The connection between the container end panel and the flange is designed to be secure and tightly sealed at that interface so as to prevent the flange from pushing in or out axially and to prevent the flange from rotating relative to the container end panel as the closing plug is tightened into position.

The flange is internally threaded for receipt of the externally threaded plug. As will be disclosed herein, these flange and plug closure assemblies typically include some type of sealing gasket or sealant, or both. As will be described, in the context of the present invention the referenced closure assembly includes, in addition to the flange and plug, an annular gasket that is positioned between the plug and a portion of the container end panel. Once the plug is properly tightened in position into the flange and the annular gasket is compressed radially, a leak-free closure assembly is created. In the present invention, all of the securement of the flange and sealing of the closure assembly is the result of the specific design, the ability to utilize higher crimping pressures and forces, and the positioning of the annular gasket for its radial compression between the plug and the container end panel. The inner surface of the plug, radially inwardly of its peripheral serrations, is angled to improve the interaction of the gasket with the plug and container end. Included as a part of this specific design refinement is an angled or contoured surface on the plug that receives the gasket. Gasket performance is enhanced by these design improvements as will be described.

More specifically, the present invention relates to the design and construction of a threaded flange and threaded plug combination wherein the dimensions and dimensional relationships are selected to create a smaller overall combination that can be used on smaller containers and provides the well established thread systems for dispensing and threaded drum accessories presently used. A structural feature related to this smaller size design is the forming of the container end panel as a back up to reinforce the wall of the flange during securement into the container end panel. A related design improvement includes various shaping and geometry refinements for the flange and for the plug that are intended to improve performance and provide additional benefits.

While threaded flange and closing plug combinations are known in the art, it is also known that significant differences in reliability and performance can result from relatively minor design changes. This is why it is important to understand the precise nature and importance of the specific dimensions, the dimensional relationships, and the shapes of the flange and the cooperating closing plug as part of the present invention. The specific features of the present invention and their importance to the overall reliability and performance of the disclosed closure assembly will be described herein.

SUMMARY OF THE INVENTION

A closure assembly for a container according to one embodiment of the present invention comprises, in combination, an annular flange constructed and arranged with a threaded plug opening, a threaded closure plug having a threaded outer portion, and an annular gasket positioned radially between the closure plug and a portion of a container end panel that is formed over and around the annular flange so as to present an inner axial wall that is positioned adjacent the annular gasket and provides one surface for gasket compression. The radial distance between the closure plug and the inner axial wall of the container end panel relative to the size of the annular gasket determine the degree of radial compression of the annular gasket.

One object of the present invention is to provide an improved closure assembly for a container Related objects and advantages of the present invention will be apparent from the following description.

DESCRIPTION OF THE PREFERRED EMBODIMENTS

Figure 1:
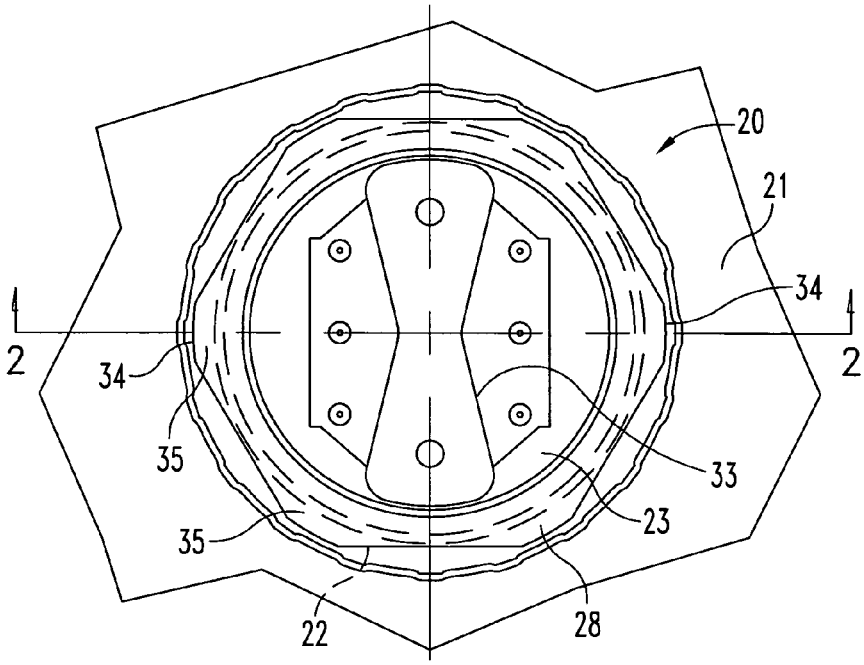
FIG. 1 is a top plan view of a closure assembly for a container, as installed, according to a typical embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
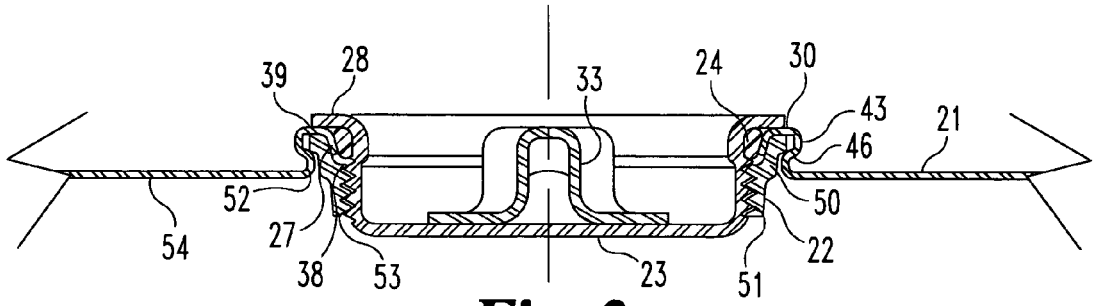
FIG. 2 is a front elevational view, in full section, of the FIG. 1 closure assembly as viewed along line 2-2 in FIG. 1.
Figure 6:
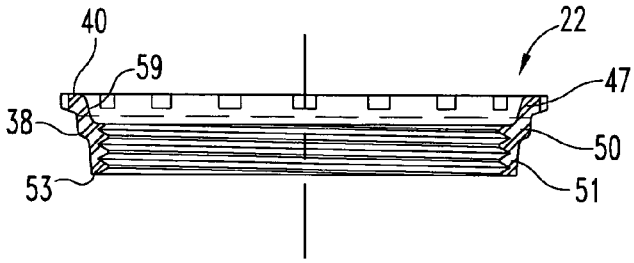
FIG. 6 is a front elevational view, in full section, of the FIG. 5 flange as viewed along line 6-6 in FIG. 5.
Figure 7:
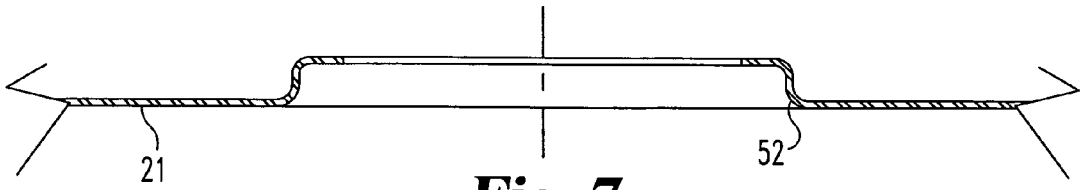
FIG. 7 is a front elevational view, in full section, of a container end panel as initially formed for receipt of the FIG. 1 closure assembly.

Referring to FIGS. 1 and 2, there is illustrated a closure assembly 20 as installed into a container end panel 21. Closure assembly 20 includes flange 22 (see FIGS. 5 and 6), closing plug 23 (see FIG. 3), and annular gasket 24. The flange 22 which is annular in form and internally threaded is contoured and shaped for secure receipt by end panel 21 as the end panel 21 is shaped, drawn, and compressed over, in, and around flange 22 (see FIG. 4). The originating form of the container end panel 21, as it is pierced and drawn, is illustrated in FIG. 7. In most applications a larger opening, flange, and plug combination is used for filling and dispensing. A smaller opening, flange, and plug combination is used for venting. The standard flange and plug sizes, as commonly used or referenced in the industry, include the sizes of NPS ¾ inch (25 mm), NPS 1½ inches (45 mm), and NPS 2 inches (57 mm).

The closing plug 23 is externally threaded for secure, leak-free threaded engagement with flange 22. The annular gasket 24 is pre-assembled onto closing plug 23 in what is considered a generally cylindrical gasket-receiving portion 23*a*. As is illustrated, the annular gasket 24 is positioned between the closing plug and the inner wall 27 of end panel 21 and is ultimately compressed between these two surfaces so as to establish a radial seal between and against closing plug 23 and inner wall 27. In this way, even if there is a chance for liquid leakage between the container end panel 21 and flange 22, it does not leak past the radially compressed annular gasket 24. Any possible liquid leakage through the threaded engagement will also be stopped by annular gasket 24. This specific positioning of gasket 24 enables only one gasket to be used for the closure assembly, as contrasted to other designs that require two gaskets in order to create an effective liquid-tight seal for the combination or assembly.

The annular gasket 24 is compressed radially between the closing plug 23 and the inner wall 27 and the extent or degree of compression is generally independent of the tightening torque applied to the closing plug as it is tightened (threaded engagement) into flange 22. The radial clearance space (on a side) between the closing plug 23 and the inner wall 27 of container end panel 21 determines in part the degree of compression of annular gasket 24. The balance or remainder of this equation is controlled by the size of the gasket in terms of its lateral cross section diameter. Importantly, the degree or extent of gasket compression in this radial direction is not a function of the tightening torque. Instead, by simply comparing the radial width of the separation between the closing plug 23 and inner wall 27 with the lateral cross section diameter of the annular gasket, it will be easy to determine the degree or extent of compression of the annular gasket in a radial direction.

The only other location that might enable use of a single gasket is between the radial lip 28 of plug 23 and end panel 21. However, in this location for gasket 24 it is not possible to pre-assemble the gasket 24 to the plug 23. Importantly, it would also not be possible to tighten the plug 23 into the flange 22 until the underside 29 of lip 28 contacts the upper surface 30 of end panel 21. The ability to establish this direct surface-to-surface contact between the plug 23 and the end panel 21 is one advantage of the present invention. If an annular gasket needed to be positioned for the liquid-tight sealing between radial lip 28 and the upper surface 30 of end panel 21, then this particular feature of the present invention would not be available. By selecting the cooperating thread pitch and thread lengths relative to the remaining sizes and dimensions of plug 23 and flange 22, it is possible to design these components such that at about the point that the desired tightening torque of the plug 23 into the flange 22 is reached, the underside 29 of radial lip 28 is almost (less than 0.8 mm) in contact with the upper surface 30 of the container end panel 21. From this point forward, in terms of advancing the plug into the flange, a very slight increase in the tightening torque brings these two surfaces into contact with one another. This in turn provides both a visual determination of proper tightening of the plug as well as a mechanical stop to prevent over tightening and possibly rupturing gasket seal materials. By means of this quick and simple visual inspection of the two surfaces being in contact, it is possible to determine, visually, that the desired tightening torque has been reached. As such, a torque wrench is not required in order to set the proper tightening torque between the closing plug 23 and the flange 22. As soon as these two surfaces touch, the tightening of the plug 23 into the flange 22 can be stopped and the requisite torque will be reached.

Figure 3:
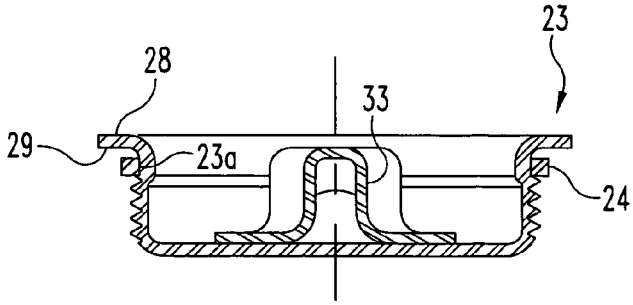
FIG. 3 is a front elevational view, in full section, of a closing plug and annular gasket comprising portions of the FIG. 1 closure assembly.

The outside diameter size of gasket 24 in its installed condition on plug 23 is noticeably smaller than the outside diameter size of radial lip 28. While this outside diameter size of gasket 24 is larger than the inside diameter of inner wall 27, thereby providing for gasket compression, recessing the annular gasket relative to radial lip 28 permits radial lip 28 to contact upper surface 30 of the container end panel in order to establish the metal-to-metal contact at that point. The annular gasket position relative to the remainder of closing plug 23 is illustrated in FIG. 3 and the assembly and compression of annular gasket 24 is illustrated in FIG. 2. The interior form or structure 33 of plug 23 can be used for manual or machine tightening of plug 23 into flange 22. The hex-shaped configuration of lip 28 (its outer periphery) is an ornamental design feature that provides a trademark to identify the particular manufacturer as the source of origin. The bow-tie shaped torque bar 33 enables the plug to be tightened into the flange by means of a conventional drum wrench or adapter. By using the described surface-to-surface contact as the means to set the proper desired torque, there is virtually no risk of over tightening.

Figure 4:
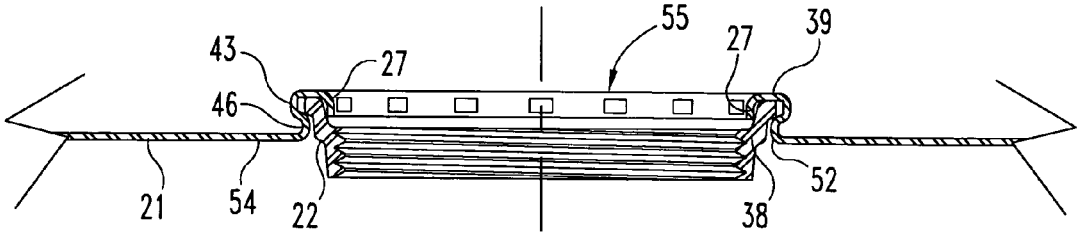
FIG. 4 is a front elevational view, in full section, of a flange as installed in a container end panel as illustrated in FIG. 1 and as corresponding to the present invention.

Another feature of the present invention is the sizing of the hex-shaped lip 28 relative to the outside diameter of flange 22, as installed in the end panel, see FIGS. 2 and 4. The largest diametral dimension across lip 28 is across opposing flats 34 of the hex projections 35 and this dimension is less than the outside diameter of upper surface 30. As such, the flats 34 do not project beyond the outside diameter of upper surface 30 and this in turn protects the hex projections 35 from being hit or bumped in any way that might loosen the plug 23. This design also prevents the hex projections 35 from abutting against or abrading any nearby structures or surfaces. Dimensionally this described relationship applies primarily to the larger plug sizes. In the case of the NPS ¾ inch (vent) plug, the plugs outermost dimension may extend beyond the outermost point of the assembled flange.

Figure 5:
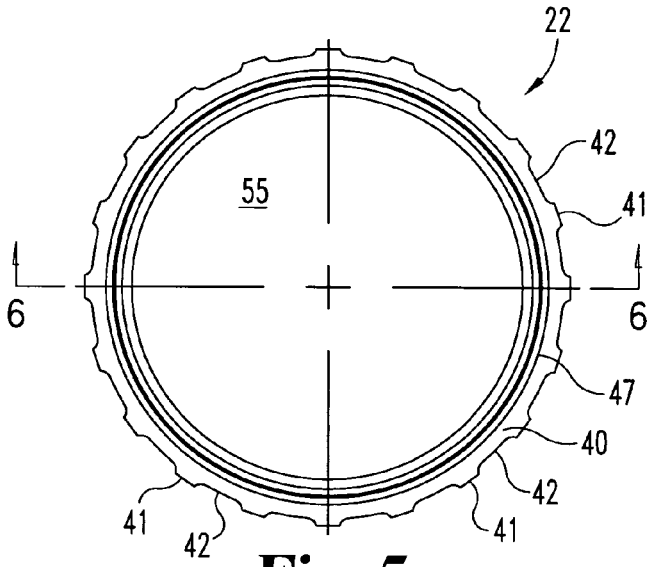
FIG. 5 is a top plan view of the FIG. 4 flange.

With continued reference to FIG. 4, it will be noted that the container end panel 21 is formed around and over flange 22 with inner axial wall 27 on the inside diameter of flange wall 38. The upper wall section 39 that provides upper surface 30 of container end panel 21 contacts the upper surface 40 of flange 22. As illustrated in FIG. 5, flange 22 includes a series of equally-spaced, generally rectangular serrations 41 that are circumferentially spaced around the circumference of flange 22 in alternating sequence with recesses 42. A total of twenty (20) serrations on eighteen degree radially-spaced centerlines are provided and outer wall 23 of panel 21 is formed circumferentially around each serration 41. For the NPS ¾ inch flange, there are sixteen (16) serrations. This changes the size of the recesses and the degrees of spacing accordingly. As the metal of panel 21 is formed into each recess 42, as illustrated in FIG. 1, it creates a secure, interlocking relationship. This interlocking design prevents any rotation of flange 22 relative to the container end panel 21.

The annular recessed portion 46 of outer wall 43 is formed beneath the annular radial lip 47 of flange wall 38. This construction, in cooperation with upper wall section 39, actually sandwiches the radial lip 47 between two portions of end panel 21. This in turn prevents push-in or pull-out of flange 22 in an axial direction relative to container end panel 21.

The inner wall 27 and outer wall 43 both of end panel 21 are similarly configured in radially opposing form such that the radial lip 47, including serrations 41 and recesses 42, is radially sandwiched between inner wall 27 and outer wall 43. It is the outer surface of the radial lip 47 that defines the serrations 41 and recesses 42. The radially inward force used to form end panel 21 into recesses 42 and around the serrations 41 could distort the shape of flange 22 if used alone, depending on sizes, materials, and material dimensions. Any such distortion could cause a problem with the proper receipt of plug 23.

One way to avoid this potential problem is to enlarge the wall thickness of flange 22. With a standard plug size, this requires a larger outer wall outside diameter for the flange. This then increases the overall size and this could limit the containers that this larger flange can be used with. By using inner wall 27 as a reinforcing back up structure for flange 22 and by using a metal flange, a relatively high crimping force can be applied to the exterior and in an opposite direction to the interior. These forces are applied against the material of the container end panel 21, specifically against outer wall 43 in a radially-inward direction and against inner wall 27 in a radially-outward direction.

This particular construction permits the application of forces to the container end panel 21 against flange 22 that are significantly higher than that used in earlier designs with synthetic material flanges and/or designs without a back up interior wall, such as interior wall 27. By being able to apply significantly higher forces, it is possible to compress the inner and outer walls 27 and 43 against the corresponding surfaces of the flange to achieve a tight, metal-to-metal seal. Serrations, such as serrations 41, are not actually required under this design of the present invention for proper anchoring of the flange into the container end panel. It is even possible to create indentations into the flange material for the container end panel to lock into in order to prevent rotation of the flange 22 relative to the container end panel 21. As will be understood, the higher crimping pressures that can be applied enable a secure connection without the need for any serrations. However, if some shaping is desired for the flange, the higher pressures or forces of the present invention permit optional shapes, indentations, etc., to be used as part of the flange 22 or as part of the container end panel 21, or both.

A further benefit of using metal for flange 22 in lieu of a synthetic material is the durability of the metal. A related benefit is the heat resistance of the metal. In terms of durability, it is possible for synthetic material flanges to show wear over time in addition to being more prone to damage. The wear and/or damage could reach a level requiring a replacement of the flange, well before the remainder of the closure and container requires replacement. If the flange and its connection into the container end panel are not configured for replacement of the flange, then the entire container has to be replaced and very likely before the end of its useful life. If the flange and its connection to the container are configured for replacement of the flange, then this likely adds additional cost in terms of design features. Further, designing the flange and its connection into the container end panel for replacement of the flange could affect or compromise other design aspects or features that might be desired.

By changing from a synthetic material flange to a metal flange, these wear issues and related concerns are all avoided, allowing the flange to remain in an acceptable condition for continued use for essentially as long as the remainder of the closure and the container remain in an acceptable condition for continued use. As noted, the use of a metal flange, combined with the back up feature provided by inner wall 27 and outer wall 43, enables higher pressure forces for crimping or compressing the container end panel material into and around the flange material. This sealed and secure connection that results from these higher forces precludes the need for any additional sealant, an aspect often required by prior art designs.

In terms of the heat resistance, it should be noted that containers of the type used with closure assembly 20 are usually cleaned, refurbished, and reused. One part of the cleaning process is to subject the container and its closure assembly to an elevated temperature. The heat level that the flange is exposed to requires the use of heat resistant material whenever a synthetic material is used for the flange. Such materials are more expensive than counterpart materials that are not heat resistant. This accordingly adds cost to the closure assembly. The metal to be used for flange 22 would be considered heat resistant without adding to the cost of the closure assembly. A further concern when a sealant is used is that this sealant may be rendered useless as a result of the high temperature cleaning procedure. This then either renders the container useless or requires the addition of a separate seal assembly, adding time and cost to the refurbishment.

In some prior designs for closure assemblies for containers of the type being described herein, an added component part is required. This added component part is described as a crimping ring or retaining ring. Its purpose is to provide a connection interface between the flange and the container end panel when those two components alone are not able to be designed for the required connection and the requisite performance. This inability may be due to the specific part configuration selected or may be due to the material choices, or some combination of the two. The higher forces that can be applied with the present invention preclude the need for any "extra" component part, whether a crimping ring, retaining ring, or some other component that would simply add to the cost and complexity of that closure assembly.

With continued reference to FIGS. 2, 4 and 6, it will be seen that flange 22 includes two recessed annular wall sections 50 and 51 positioned below serrations 41. Wall section 50 appears as a bulging portion of wall section 51 and wall section 50 is positioned in the FIG. 2 assembly in close proximity to bend 52 of container end panel 21. Without the "bulge" wall section 50, one of two consequences would result from the overall design. First, if the wall section 50 is configured to be the same outside diameter as wall section 51, then there would be a substantially larger clearance gap between the flange wall section 50 and the container end panel. Having a larger gap in this location would mean having a larger area for collecting residue of the contents. More collected residue requires more time to properly clean the container and closure assembly for re-use. Wall section 50 is axially adjacent to wall section 51 and as illustrated they are radially offset from one another.

If the thickness of wall section 51 is enlarged to match the outside diameter of wall section 50, then the flange becomes a heavier and more expensive component part due to the excess metal that is added. The present invention strikes a balance between these two competing interests by using a smaller wall outside diameter for wall section 51 and a larger wall outside diameter for wall section 50 to fit closely up against bend 52.

The installed configuration of flange 22 into the container end panel 21 is considered to be a "low profile" design due to the design flexibility that is afforded by the construction of flange 22. By forming bend 52 with a larger radius, as compared to prior art configurations, the flange 22 is able to be mounted at a raised or elevated height relative to the underside surface 54 of the container end panel. Raising the flange 22 in this manner raises the entire flange, including the lower edge 53 and the bulge at the transition between wall sections 50 and 51. By making the axial "height" difference between the lower edge 53 and the underside surface 54 smaller or shorter, as compared to prior art designs, there is less material (i.e., container contents) that is able to be trapped or left in the container. While this is not an issue until the container is inverted, it will be seen that under such circumstances, the flange wall serves as a dam to prevent the flow of contents by way of the internally-threaded plug hole 55 in flange 22. Some of this low profile design and the reduction in the amount of trapped contents is facilitated by the flange wall configuration and the bulge of wall section 50.

Figure 8:
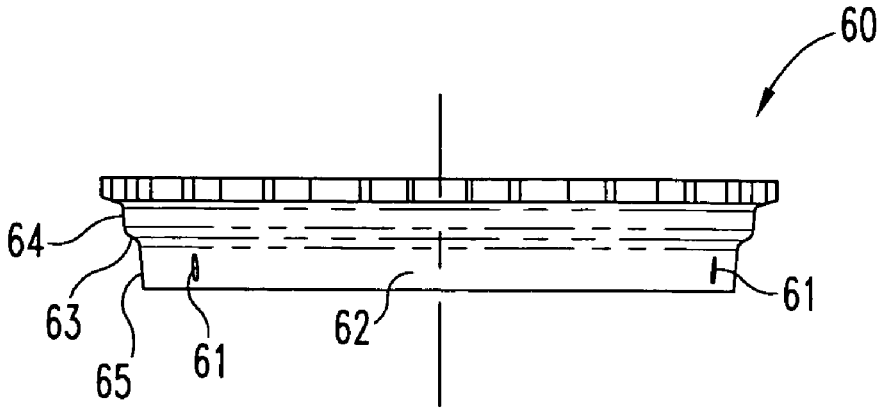
FIG. 8 is a front elevational view of an alternative flange that is suitable for use with a closure assembly according to the present invention.

An added enhancement to the low profile design of flange 22 is illustrated as part of alternative flange 60, see FIG. 8. Flange 60 is constructed with a plurality of drain holes 61 that are positioned in sidewall 62 immediately below the bulge 63 that coincides with the transition region between wall sections 64 and 65. By creating drain holes 61 at a location that is axially close to the underside surface 54, there is virtually nothing to block or restrict the container contents from draining completely as the container is emptied. While a slight raised portion of wall section 65 might still trap some of the container contents, the amount trapped in relative terms is negligible.

With a plurality of drain holes 61, the focus on a low profile construction is less important for emptying the container, but it remains beneficial in terms of reduced material. In the FIG. 8 illustration, two drain holes 61 are shown on 120 degree spacing, based on a design having three equally-spaced drain holes. Three drain holes 61 is considered to be the preferred number, but virtually any number can be used so long as the number is not excessive to the point that the overall strength and rigidity of the flange 60 is reduced.

The "bulge" at the transition region between wall sections 50 and 51 has an outside diameter that is just slightly smaller than the outside diameter of the serration ring portion of flange 22. This helps to contribute to a self-centering feature such that there is less risk of shifting or misalignment of the flange 22 within the formed portion of the container end panel 21 as the tooling compresses the material of panel 21 around flange 22.

One important feature of the present invention involves the shaping and sizing of inner wall 27. As would be appreciated from a careful review this present invention and prior art designs, inner wall 27 is substantially larger in an axial direction than the outer wall 43 and substantially larger than prior art designs. Having a substantially longer (axially) inner wall 27 means that the area, even with a smaller diameter, is larger, as compared to outer wall 43. When the crimping or compressing pressure is applied over this larger area, the total force is increased over what would be possible with that same pressure applied over a smaller area. A related feature of the present invention is the action and reaction of the radial sealing gasket 24 as the container end panel 21 is compressed around the flange. The gasket 24 is not compressible when it is annularly captured as in the present invention.

With regard to inner wall 27 which provides a vertical sealing surface for gasket 24, this inner wall may have, as a result of its forming operation, an approximate three degrees (3°) of spring back, causing it to deflect inwardly off of vertical. However, utilizing the high pressure insertion forces that are part of the present invention, a smooth sealing surface across inner wall 27 can be achieved and by using this longer axial length, as compared to prior art inner walls, there will actually be less spring back with inner wall 27. Nevertheless, there may be some value in having a sealing surface with some modest spring back inwardly off of vertical as this would tend to accommodate or facilitate gasket compression and would also facilitate the proper release of the gasket when removing the closing plug 23. It will also be noted from the construction illustrated in FIG. 2 that there is a clearance area below inner wall 27 providing a space for the sealing gasket 24 to extrude into, thereby avoiding excessive compression and avoiding material rupture. Without this clearance space, it might be required to cut or shave a portion of the elastomeric material off of the sealing gasket to avoid the possibility of material rupture.

Figure 9:
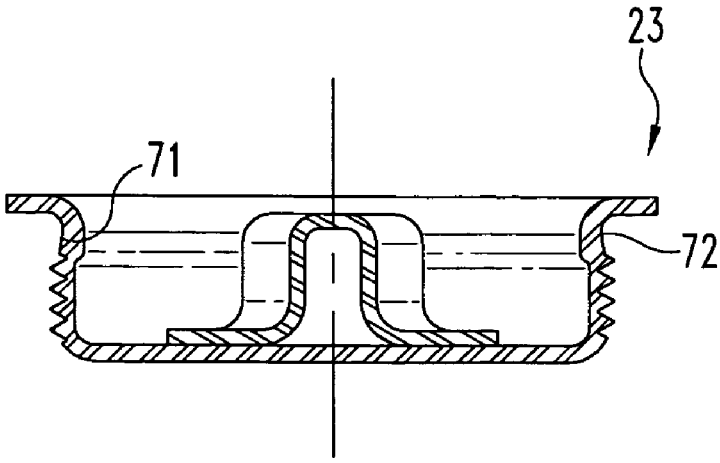
FIG. 9 is a front elevational view, in full section, of an alternative construction for a suitable closing plug for use with a closure assembly according to the present invention.
Figure 10:
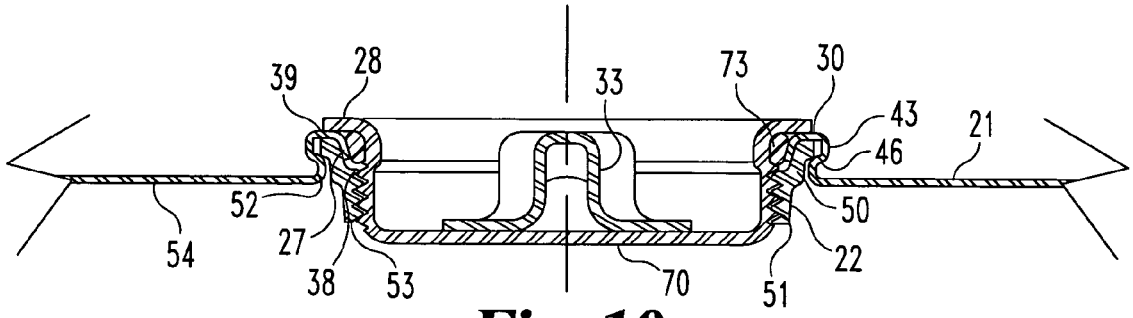
FIG. 10 is a front elevational view, in full section, of the FIG. 9 closing plug as installed as part of a closure assembly according to the present invention.

While working with flange 22 and closing plug 23 and with various styles of sealing gaskets, it was learned that under certain circumstances, depending on the specific materials, dimensions, shapes, and tolerances, etc., gasket rolling or twisting could occur. While this is not a regularly or consistently occurring event, it does happen depending on the particular combination of component part configurations. It would therefore be helpful in the design of a cooperating plug and flange with an intermediate sealing gasket if the risk of occurrence of gasket rolling or twisting could be reduced so as to allow greater freedom in the selection of the sealing gasket and to enable a preferred construction. One part of the solution conceived by the inventor is illustrated in FIG. 6. Another part of the solution is illustrated in FIGS. 9 and 10 in the form of closing plug 70.

The inner wall surface 59 of radial lip 47 has an inverted, frustoconical form, such that it diverges radially outwardly as it extends upwardly from the threads of wall 51 in the direction of upper surface 40. The angle of incline is approximately between 10 degrees and 15 degrees. With this angled surface 59 as part of flange 22, the metal of the container end that is formed into inner wall 27 also assumes an inverted, frustoconical shape, also diverging at between 10 and 15 degrees, upwardly and outwardly.

By creating this angled surface on inner wall 27 as one side of the gasket 24 compression, the gasket 24 is able to be squeezed diametrically as part of the gasket compression process with plug 23 without the gasket 24 twisting or rolling. This angled surface also facilitates gasket separation from the inner wall 27 as the plug 23 is removed from its threaded engagement with the flange 22. If inner wall 27 is alternatively formed as an axially straight (cylindrical) wall, it is possible for the gasket 24 to become wedged between this inner wall and the plug and not release with the plug which is desired. The wider opening at the top of flange 22 makes it easier to begin the threaded engagement of the plug 23 with gasket 24 being carried by the plug.

Closing plug 70 has a construction that is virtually identical to plug 23 with the lone exception being the shape of gasket-receiving portion 23*a*. Portion 23*a* of plug 23 is replaced by gasket-receiving portion 71 of plug 70. The specific configuration of portion 71 includes a concave surface 72 that receives the sealing gasket. By shaping portion 71 with a concave surface 72, the selected gasket 73 (see FIG. 9) is encouraged to remain with the plug as the plug is removed from threaded engagement with the flange.

By creating a concave surface 72 as part of portion 71, the selected gasket 73 is more likely to remain assembled onto the plug 70 as the plug is threaded into and removed from the flange 22. Having a higher probability that the gasket remains with the plug throughout the threading actions of the plug into and out of the flange 22 is a benefit of the present invention. If the gasket 73 comes off of plug 70 or if it would initially stay with the flange as the plug is removed, it could fall off into the container and contaminate the contents. If the gasket is initially removed with the plug but later falls off, it could be lost and thereby prevent proper resealing of the container. Whatever the occurrence, it is clearly advantageous to configure plug 70 in such a way so as to retain the selected gasket 73 with the plug throughout the life of the plug and/or the life of the gasket.

A further feature of the present invention includes a consistently sized inner sealing axial surface provided by inner wall 27. One of the realities that the present invention has to address is that in the manufacturing of container end panels, there may be various metal thicknesses encountered, while at the same time there is a desire to have a consistent size in order to control gasket compression. While there are advantages, as noted above, for providing inner wall 27 as a structural back up to the flange 22, placing the material of inner wall 27 on the interior of the flange results in inside diameter variations as the material thickness of the container end panel varies.

As has been described, the insertion forces associated with the present invention are substantial and these forces are substantial on the axial contact area associated with inner wall 27. By providing substantial forces in this area, it is possible to actually increase the inside diameter defined by inner wall 27 while also increasing the flange and panel outside diameter around serrations 41 covered by outer wall 43. The inner axial contact area of inner wall 27 is substantial enough to provide adequate surface area to enlarge the flange and container end panel material to compensate for the various metal thicknesses that might be present and the tensile stresses to be encountered from enlarging the flange. This inner axial contact area provided by inner wall 27 is also substantial enough to resist the compressive forces during high pressure insertion which are additional to those aforementioned stresses required to enlarge the flange and end panel.

A further feature of the present invention includes the ability to incorporate a smaller size, something less than 7.0 mm, in the area of upper surface 40, specifically that structural portion of flange 22 extending between the inside diameter above threaded plug hole 55 and the serrated exterior wall defined by serrations 41. Considering prior art flange structures, this dimension is typically larger than 9.5 mm, on a side, and thus the present invention allows an approximate twenty-six percent (26%) reduction. One of the reasons for the prior art structures requiring this larger wall size or dimension is to be able to resist the compressive insertion forces and/or the physical requirements needed to accommodate a sealing gasket positioned between an upper flange wall and the upper surface of the container end panel. Some of the advantages of being able to use a smaller dimension in this area include the ability to use the present invention on smaller containers and a design that requires less material that in turn results in less weight and a material cost savings.

A further feature of the present invention includes the relatively high insertion pressures that cause yielding or stretching of the container end panel material along the horizontally extending upper annular surface 30. This yielded material assists in keeping the contact pressure of the inner axial wall 27 and the flange outer wall defined by serrations 41 and recesses 42 for producing a metal-to-metal seal and rigid assembly.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A closure assembly for a container, said container including a container end panel defining a closure assembly-receiving opening, said closure assembly comprising:

an annular flange constructed and arranged with a threaded plug opening and an inner surface located axially above and radially outwardly of said threaded plug opening, said annular flange further including an annular sidewall defining a plurality of drain holes, said annular flange including an upper flange lip that is adjacent an axial end of said annular sidewall, said annular sidewall having two sections that are axially adjacent with one section being radially offset from the other section, said upper flange lip having an outer periphery that is radially outwardly of said annular sidewall;

a closure plug having a threaded outer portion and being constructed and arranged to be received by said threaded plug opening, said threaded closure plug further including a radial lip and a gasket-receiving portion that is axially between said threaded outer portion and said radial lip; and an annular gasket positioned around and in contact against said gasket-receiving portion.

2. The closure assembly for a container of claim 1 wherein said upper flange lip including an upper surface extending between said inner surface and said outer periphery, the radial dimension between said inner surface and said outer periphery is less than 7.5 mm.

3. The closure assembly for a container of claim 1 wherein said gasket-receiving portion is concave, opening radially-outwardly.

4. In combination:

a container having a container end panel that is formed with an inner axial wall, an outer axial wall and a connecting upper wall, said inner axial wall defining an opening;

a closure assembly including an internally-threaded annular flange that is installed into said container end panel, a closure plug having a concave gasket-receiving portion, and an externally-threaded portion for threaded assembly into said annular flange and an annular gasket positioned around and in contact with said gasket-receiving portion and positioned between said gasket-receiving portion and said inner axial wall; and wherein said annular flange includes an upper wall portion positioned between said inner axial wall and said outer axial wall and wherein said annular gasket is in contact with said gasket-receiving portion and said inner axial wall and is radially compressed between said gasket-receiving portion and said inner axial wall, and wherein said annular flange defines a plurality of drain holes, said annular flange including an upper flange lip that is adjacent an axial end of an annular sidewall, said annular sidewall having two sections that are axially adjacent with one section being radially offset from the other section, said upper flange lip having an outer periphery that is radially outwardly of said annular sidewall.

5. In combination:

a container having a container end panel that is formed with an inner axial wall, an outer axial wall and a connecting upper wall, said inner axial wall defining an opening;

an internally-threaded annular flange installed into said container end panel, said internally-threaded annular flange including a threaded plug opening and a frustoconical inner surface located axially above and radially outwardly of said threaded plug opening, said frusto-conical inner surface having an angle of incline of approximately between 10 degrees and 15 degrees;

a closure plug having a radial lip, an externally-threaded portion for threaded assembly into said annular flange and a concave gasket-receiving portion positioned between said externally-threaded portion and said radial lip;

an annular gasket positioned around and in contact with said gasket-receiving portion; and wherein said closure plug and said annular flange are constructed and arranged such that a desired tightening torque for said closure plug into said annular flange is achieved when said radial lip contacts said connecting upper wall.

6. The combination of claim 5 wherein the interface between said radial lip and said connecting upper wall is free of any sealing gasket.

7. The combination of claim 6 wherein said annular flange further includes an annular wall section that is axially spaced from said upper wall portion, said upper wall portion including an outer surface that is radially outward of said annular wall section.

8. In combination:

a container having a container end panel that is shaped with an inner wall, an upper wall section, an outer wall, and a bend beneath said outer wall, wherein the upper wall section extends between said inner wall and said outer wall; and an internally-threaded annular flange installed into said container end panel, said annular flange being constructed and arranged with an upper flange lip that is adjacent an axial end of an annular sidewall, said annular sidewall having two sections that are axially adjacent with one section being radially offset from the other section, said upper flange lip having an outer periphery that is radially outwardly of said annular sidewall, wherein one section of said sidewall is in close proximity of said bend, said upper flange lip having an upper surface and said upper wall section extending across said upper surface.

9. A closure assembly for a container, said container including a container end panel defining a closure assembly-receiving opening, said closure assembly comprising:

an annular flange constructed and arranged with a threaded plug opening and an inner surface located axially above and radially outwardly of said threaded plug opening, said annular flange further including an annular sidewall, said annular flange including an upper flange lip that is adjacent an axial end of said annular sidewall, said annular sidewall having two sections that are axially adjacent with one section being radially offset from the other section, said upper flange lip having an outer periphery that is radially outwardly of said annular sidewall;

a closure plug having a threaded outer portion and being constructed and arranged to be received by said threaded plug opening, said threaded closure plug further including a radial lip and a gasket-receiving portion that is axially between said threaded outer portion and said radial lip; and an annular gasket positioned around and in contact against said gasket-receiving portion, said annular gasket being constructed and arranged to be formed into a sealing configuration against a portion of said container end panel that is overlaying said inner surface when said closure plug is threaded into said annular flange.

10. In combination:

a container having a container end panel that is formed with an inner axial wall, and outer axial wall and a connecting upper wall extending between said inner axial wall and said outer axial wall, said inner axial wall defining an opening;

a closure assembly including an internally-threaded annular flange that is installed into said container end panel, a closure plug having a concave gasket-receiving portion, and an externally-threaded portion for threaded assembly into said annular flange and an annular gasket positioned around and in contact with said gasket-receiving portion and positioned between said gasket-receiving portion and said inner axial wall; and wherein said annular flange includes an upper wall portion positioned between said inner axial wall and said outer axial wall and wherein said annular gasket is in contact with said gasket-receiving portion and said inner axial wall and is radially compressed between said gasket-receiving portion and said inner axial wall, said annular flange including an upper flange lip that is adjacent an axial end of an annular sidewall, said annular sidewall having two section that are axially adjacent with one section being radially offset from the other section, said upper flange lip having an outer periphery that is radially outwardly of said annular sidewall.

11. In combination:

a container having a container end panel that is formed with an inner axial wall, an outer axial wall, and a connecting upper wall extending between said inner axial wall and said outer axial wall; and an annular flange constructed and arranged with a threaded plug opening and an inner surface located axially above and radially outwardly of said threaded plug opening, said annular flange further including an annular sidewall defining a plurality of drain holes, said annular flange including an upper flange lip that is adjacent an axial end of said annular sidewall, said annular sidewall having two sections that are axially adjacent with one section being radially offset from the other section, said upper flange lip having an outer periphery that is radially outwardly of said annular sidewall.

* * * * *

UNITED STATES PATENT AND TRADEMARK OFFICE

CERTIFICATE OF CORRECTION

PATENT NO. : 7,464,830 B2
APPLICATION NO. : 10/971874
DATED : December 16, 2008
INVENTOR(S) : Baughman It is certified that error appears in the above-identified patent and that said Letters Patent is hereby corrected as shown below:

Title Page;
In block (74), *Attorney, Agent or Firm*
Replace "Emhardy" with -- Emhardt --.

Signed and Sealed this

Twenty-first Day of April, 2009

JOHN DOLL
*Acting Director of the United States Patent and Trademark Office*